US012466615B2

(12) United States Patent
Dong

(10) Patent No.: US 12,466,615 B2
(45) Date of Patent: Nov. 11, 2025

(54) OPENING AND CLOSING MECHANISM FOR THERMALLY INSULATED CONTAINER

(71) Applicant: XIAMEN KINGQUEEN INDUSTRIAL CO., LTD., Fujian (CN)

(72) Inventor: Jinfei Dong, Fujian (CN)

( * ) Notice: Subject to any disclaimer, the term of this patent is extended or adjusted under 35 U.S.C. 154(b) by 4 days.

(21) Appl. No.: 18/607,563

(22) Filed: Mar. 18, 2024

(65) Prior Publication Data

US 2024/0217711 A1 Jul. 4, 2024

(30) Foreign Application Priority Data

Dec. 6, 2023 (CN) ..... 202311672379.6

(51) Int. Cl.

| | |
|---|---|
| ***B65D 43/16*** | (2006.01) |
| ***B65D 43/22*** | (2006.01) |
| ***B65D 53/02*** | (2006.01) |
| ***B65D 81/38*** | (2006.01) |
| ***F25D 3/08*** | (2006.01) |

(52) U.S. Cl.

CPC ..... *B65D 43/163* (2013.01); *B65D 43/22* (2013.01); *B65D 53/02* (2013.01); *B65D 81/3813* (2013.01); *F25D 3/08* (2013.01)

(58) Field of Classification Search

CPC .. B65D 43/163; B65D 43/22; B65D 81/3813; B65D 53/02; B65D 43/022; B65D 43/0208; B65D 43/0218; F25D 3/08

USPC ..... 220/221, 378

See application file for complete search history.

(56) References Cited

U.S. PATENT DOCUMENTS

| | | | | |
|---|---|---|---|---|
| 3,428,209 | A * | 2/1969 | Jenkins | F16J 15/062 D9/434 |
| 4,349,206 | A * | 9/1982 | Simm | F16L 5/12 220/378 |
| 4,854,476 | A * | 8/1989 | Serio, Jr. | B65D 53/02 220/4.01 |
| 5,225,125 | A * | 7/1993 | Wildfeuer | B65D 45/32 264/102 |
| 5,967,363 | A * | 10/1999 | Allen | B44D 3/128 220/733 |
| 6,293,286 | B1 * | 9/2001 | Gueret | A45C 13/008 220/849 |
| 6,951,340 | B2 * | 10/2005 | Suzuki | C08G 63/672 277/650 |
| 7,413,099 | B2 * | 8/2008 | Takahashi | B65D 53/02 277/648 |
| 7,578,407 | B2 * | 8/2009 | Tieben | H01L 21/67126 220/803 |

(Continued)

*Primary Examiner* — Nathan J Jenness
*Assistant Examiner* — Jennifer Castriotta
(74) *Attorney, Agent, or Firm* — Birchwood IP

(57) ABSTRACT

An opening and closing mechanism for a thermally insulated container providing good sealing effect and easy operation, including upper and lower connecting pieces pivotally connected, and a sealing ring on the lower connecting piece. The lower connecting piece also has a through hole into which a protruding part of the upper connecting piece is inserted. The sealing ring has a ring body around a side wall of the through hole, and a hook integrally connected to the ring body. The hook has a groove which faces upwardly. A flange further extends downwardly from the protruding part to be removably abutted against inner side walls of the groove so as to drive the hook of the sealing ring.

8 Claims, 5 Drawing Sheets

(56) References Cited

U.S. PATENT DOCUMENTS

2018/0118410 A1* 5/2018 Wood ..... B65D 45/22

* cited by examiner

OPENING AND CLOSING MECHANISM FOR THERMALLY INSULATED CONTAINER

BACKGROUND OF THE INVENTION

The present invention relates to the technical field of thermally insulated containers, in particular to an opening and closing mechanism for a thermally insulated container.

A thermally insulated container is a container that can achieve thermal insulation, and a more common type of thermally insulated container is a thermally insulated box or bag, mainly used in fields such as food delivery, pharmaceutics and scientific research, where objects inside are to be carried and maintained at a certain temperature. The sealing performance between the cover and the body of the thermally insulated container is the most important factor determining its functionality. Conventional thermally insulated box or bag mainly uses an airtight zipper as the opening and closing structure to realize opening and closing between the cover and the body. Because the zipper is soft and thus not fixed in shape, the zipper is difficult to be fixed during production, particularly during assembly of the zipper with the cover and the body, thereby affecting production efficiency and product yield rate. Additionally, airtight zipper is more costly than a regular zipper. Therefore, the same inventor of the present invention has invented a "NOVEL THERMALLY INSULATED CONTAINER" as disclosed by CN214297238U, wherein an upper connecting piece and a lower connecting piece are made of hard material to frame a shape of the thermally insulated container; since the shapes of the upper connecting piece and the lower connecting piece are fixed during production, it is more convenient to assemble the upper connecting piece and the lower connecting piece with the soft cover and the soft body of the container. The production process is convenient and simple, and the production efficiency, product quality, and sealing performance can be improved. A sealing ring is disposed between the side walls of a through hole of the lower connecting piece and a protruding part of the upper connecting piece so as to achieve sealing between the through hole and the protruding part when the upper connecting piece closes against the lower connecting piece, thereby ensuring the sealing effect of the thermally insulated container.

However, the product of the aforementioned patent has the following problems in practical use: Because the sealing ring is arranged between a circumferential surface of the protruding part of the upper connecting piece and the side walls of the through hole of the lower connecting piece, after the opening and closing structure is closed, the sealing ring is being squeezed against between the protruding part and the through hole as the upper connecting piece closes against the lower connecting piece, and thus the sealing ring deforms to fill a gap between the protruding part and the through hole to achieve sealing. As such, the sealing ring has an increased surface contact with the protruding part and the through hole, thereby increasing the frictional force between the components. Since the sealing ring is made of material such as rubber, stickiness of the sealing ring may be experienced at a high temperature, causing difficulties and the need of increased effort to open the closed opening and closing structure, thereby resulting in poor user's experience.

BRIEF SUMMARY OF THE INVENTION

It is an object of the present invention to provide an opening and closing mechanism for a thermally insulated container, which retains the advantages of easy assembly, high yield rate, and good sealing performance of the prior opening and closing structure, and at the same time corrects the defect of difficult opening and closing, so that opening and closing of the thermally insulated container by a user is more convenient, thereby enhancing the user's experience.

To attain the above object, the present invention provides the following technical solutions:

An opening and closing mechanism, adapted to be used with a thermally insulated container, comprising an upper connecting piece, a lower connecting piece, and a sealing ring; the upper connecting piece and the lower connecting piece are both made of hard material; a rear side of the upper connecting piece and a rear side of the lower connecting piece are pivotally connected, and an opening and closing assembly is provided between a front side of the upper connecting piece and a front side of the lower connecting piece; a through hole is formed in the lower connecting piece; a protruding part having a shape corresponding to the through hole is provided on the upper connecting piece; a size of the protruding part is smaller than that of the through hole, and the protruding part is removably fitted in the through hole as the upper connecting piece moves pivotally with respect to the lower connecting piece; the sealing ring comprises a sealing ring body mounted around a side wall of the through hole, and the sealing ring also comprises a hook part disposed around the sealing ring body and extending from an inner side of the sealing ring body into the through hole; the hook part is also integrally connected to the sealing ring body; the hook part has a groove that opens upwardly; lower edges of the protruding part further extend downwardly to define an annular flange; the annular flange abuts against inner walls of the groove as the upper connecting piece closes against the lower connecting piece, and as the annular flange abuts against the inner walls of the groove, elasticity of the sealing ring allows the hook part to be driven downwardly and along a radial direction towards a center of the through hole.

A connecting part is formed between a connecting portion of the sealing ring body and the hook part; a thickness of the connecting part is smaller than a thickness of the hook part.

Preferably, the thickness of the connecting part is one third to half of the thickness of the hook part.

An annular platform connected to the side wall of the through hole is formed in the through hole; the sealing ring body is rested on the annular platform, and the sealing ring body also abuts against the side wall of the through hole.

Preferably, the opening and closing mechanism also comprises a fixing ring; an upper surface of the annular platform is recessed to form a mounting groove; a first positioning ring extends downwardly from an outer side edge of the sealing ring body; the first positioning ring is inserted into the mounting groove; the fixing ring engages with the upper surface of the annular platform and is also fastened to the side wall of the through hole.

Preferably, a second positioning ring is formed on an upper surface of the sealing ring body, and a limiting groove corresponding to the second positioning ring is formed on a bottom surface of the fixing ring; the second positioning ring is inserted into the limiting groove.

Preferably, a fastening groove is formed on the side wall of the through hole; an outer circumferential surface of the fixing ring is provided with a fastener removably engaged with the fastening groove.

The opening and closing assembly comprises a buckle provided at the front side of the upper connecting piece and a buckling part provided at the front side of the lower connecting piece; when the upper connecting piece closes against the lower connecting piece, the buckle is buckled to the buckling part.

Preferably, the buckle is fixedly connected to a bottom surface of the front side of the upper connecting piece, and a cutaway portion is formed at the front side of the lower connecting piece; the buckling part is formed within the cutaway portion.

The hard material is injectable plastic, metal or solid wood.

According to the above technical solutions, the present invention has the following technical effects:

1) The present invention changes the conventional way of sealing the opening and closing structure in the prior art which the circumferential surface of the protruding part and the side walls of the through hole act to squeeze the sealing ring from opposite directions according to the prior art. By contrast, the present invention utilizes the coordination between the hook part of the sealing ring and the annular flange of the upper connecting piece. When the opening and closing mechanism is in a closed state, the annular flange is inserted into the groove of the hook part, and due to elasticity of the sealing ring, the hook part is driven by the annular flange downwardly and along a radial direction towards a center of the through hole, and after that, due to resilience of the sealing ring, the sealing ring tends to restore its original shape, and as such, the hook part is biased by the resilience of the sealing ring towards the inner side of the sealing ring body, and thus being tightly attached to a surface of the annular flange to achieve a sealed engagement between the hook part and the annular flange to seal the gap therebetween. Accordingly, sealed engagement between the upper connecting piece and the lower connecting piece is achieved, and the sealing performance after closing of the mechanism is ensured.

2) Additionally, since the sealed engagement between the hook part and the annular flange is achieved by the hook part being biased by the resilience of the sealing ring towards the inner side of the sealing ring body so as to tightly attached to the surface of the annular flange, while the upper connecting piece (more specifically, the annular flange of the upper connecting piece) is inserted into the groove along an axial direction of the through hole, the sealing ring generally does not generate friction force against the annular flange along the axial direction of the through hole, so that opening and closing of the opening and closing mechanism are easier, smoother, and without jamming, resulting in better user's experience.

3) Moreover, the upper connecting piece and the lower connecting piece of the present invention are made of hard material which can frame a shape of the thermally insulated container. During assembly, the upper connecting piece and the lower connecting piece can be more conveniently assembled with and connected to the cover and the body of the thermally insulated container, thereby improving the production efficiency and yield rate.

DETAILED DESCRIPTION OF THE INVENTION

Figure 1:
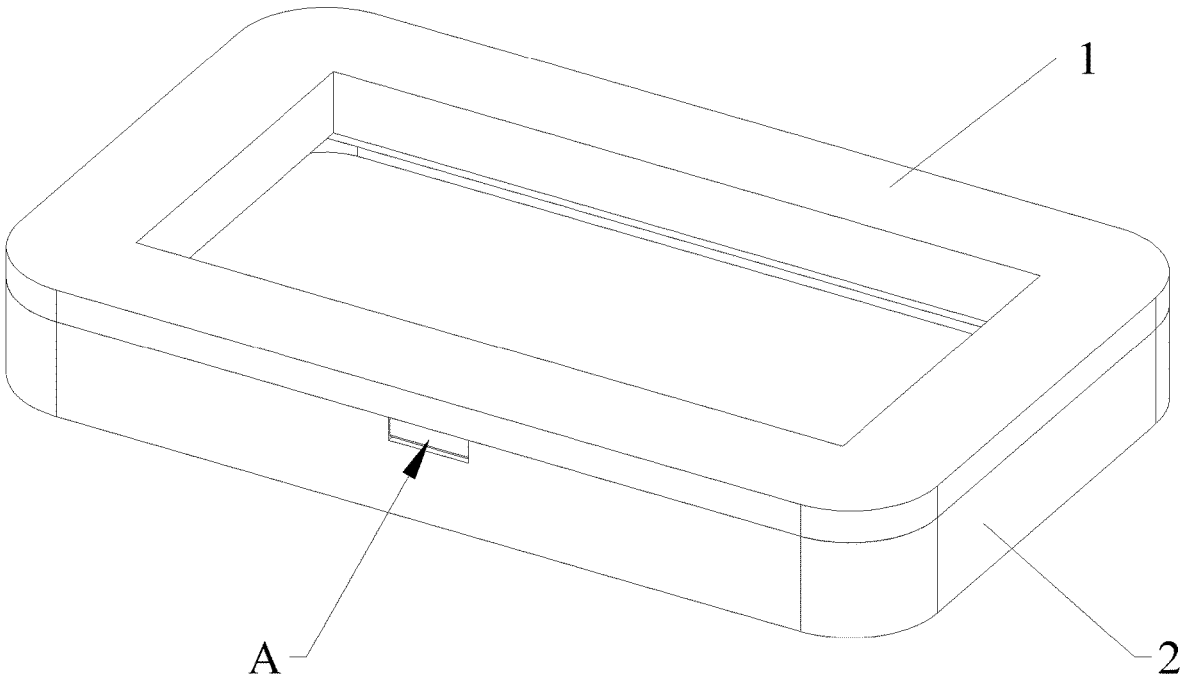
FIG. 1 is a perspective view of a closed state of a specific embodiment of the present invention.
Figure 2:
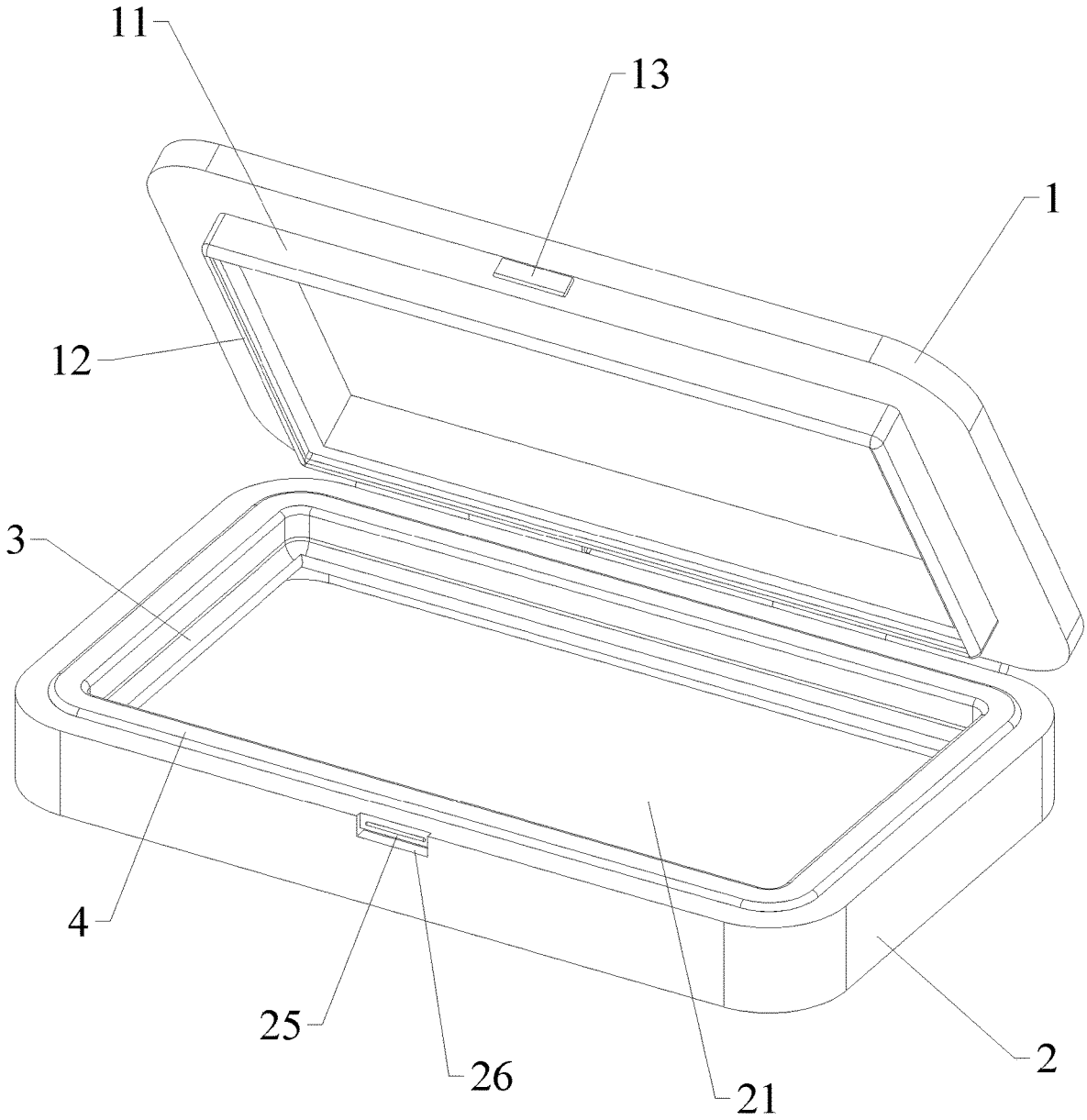
FIG. 2 is a perspective view of an open state of a specific embodiment of the present invention.

To further explain the technical solutions of the present invention, a detailed description of the present invention is provided below with reference to a specific embodiment.

With reference to FIGS. 1 to 4, the present invention discloses an opening and closing mechanism of a thermally insulated container, comprising an upper connecting piece 1, a lower connecting piece 2, and a sealing ring 3; the upper connecting piece 1 and the lower connecting piece 2 are both made of hard material.

A rear side of the upper connecting piece 1 and a rear side of the lower connecting piece 2 are pivotally connected, and an opening and closing assembly A is provided between a front side of the upper connecting piece 1 and a front side of the lower connecting piece 2.

A through hole 21 is formed in the lower connecting piece 2; a protruding part 11 having a shape corresponding to the through hole 21 is provided on the upper connecting piece 1; a size of the protruding part 11 is smaller than that of the through hole 21, and the protruding part 11 is removably fitted in the through hole 21 as the upper connecting piece 1 moves pivotally with respect to the lower connecting piece 2.

The sealing ring 3 comprises a sealing ring body 31 mounted around a side wall of the through hole 21, and the sealing ring 3 also comprises a hook part 32 disposed around the sealing ring body 31 and extending from an inner side of the sealing ring body 31 into the through hole 21; the hook part 32 is also integrally connected to the sealing ring body 31; the hook part 32 has a groove 321 that opens upwardly.

Lower edges of the protruding part 11 further extend downwardly to define an annular flange 12; the annular flange 12 abuts against inner walls of the groove 321 as the upper connecting piece 1 closes against the lower connecting piece 2, and as the annular flange 12 abuts against the inner walls of the groove 321, elasticity of the sealing ring 3 allows the hook part 32 to be driven by the annular flange 12 downwardly and along a radial direction towards a center of the through hole 21.

Figure 3:
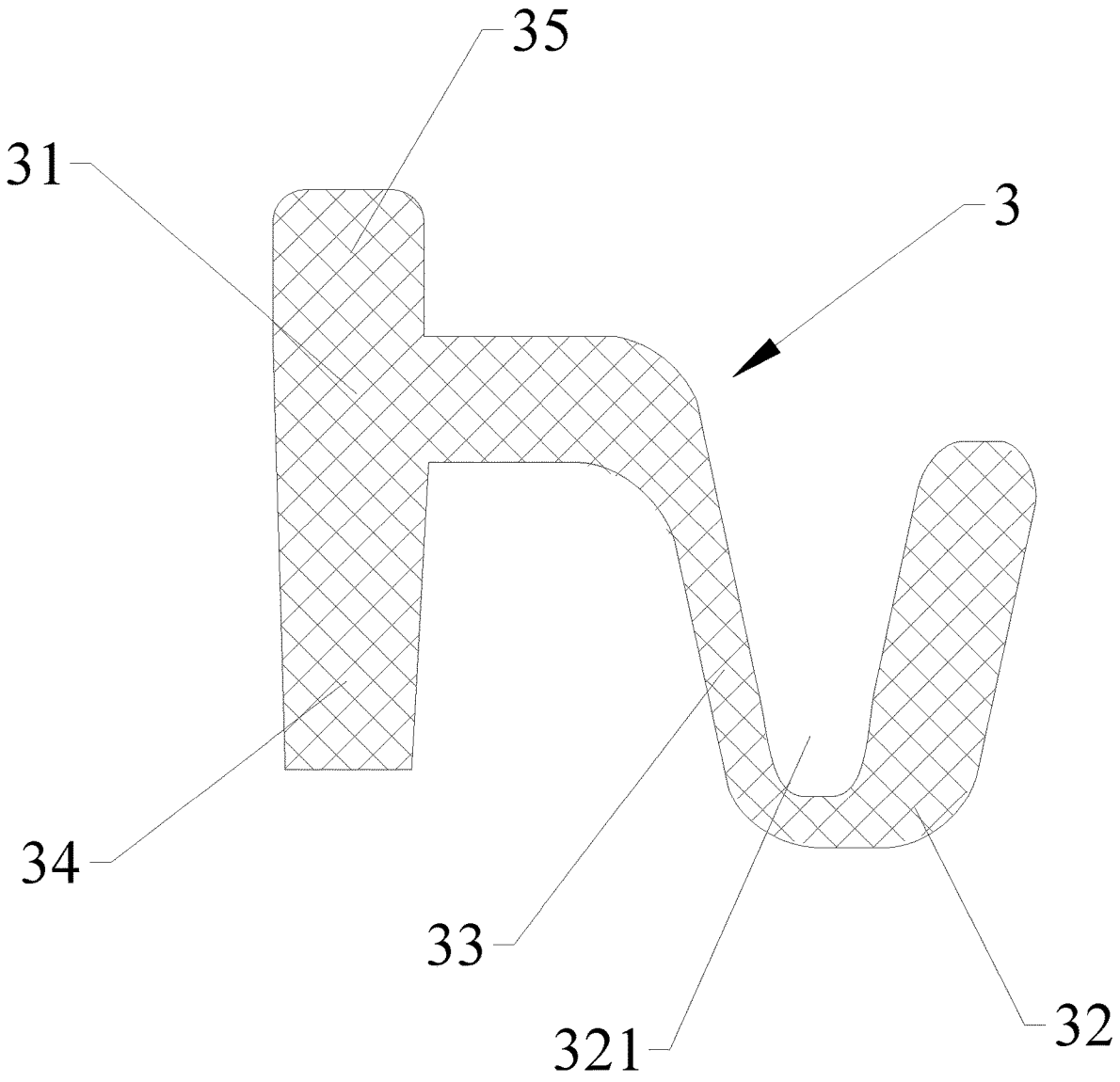
FIG. 3 is a sectional view of a sealing ring according to a specific embodiment of the present invention.
Figure 4:
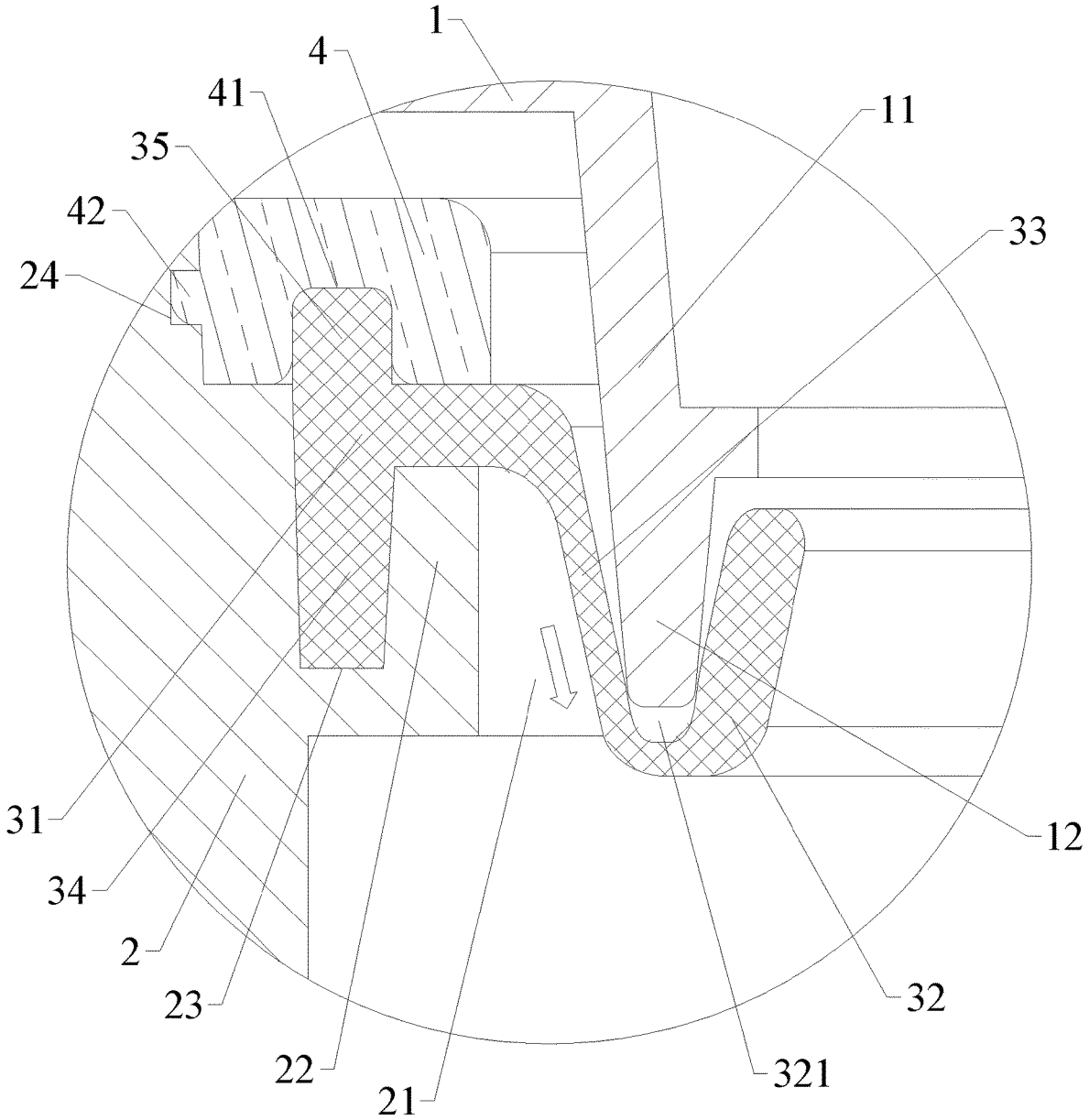
FIG. 4 is a cross-sectional view of a partial structure according to a specific embodiment of the present invention.

According to the above technical solutions, the present invention changes the conventional way of sealing the opening and closing structure in the prior art which the circumferential surface of the protruding part and the side walls of the through hole act to squeeze the sealing ring from opposite directions according to the prior art. By contrast, the present invention utilizes the coordination between the hook part 32 of the sealing ring 3 and the annular flange 12 of the upper connecting piece 1. As shown in FIG. 3 and FIG. 4, when the opening and closing mechanism is in a closed state, the annular flange 12 is inserted into the groove 321 of the hook part 32, and due to elasticity of the sealing ring 3, the hook part 32 is driven by the annular flange 12 downwardly and along a radial direction towards a center of the through hole 21 (as indicated by the arrow in FIG. 4), and due to resilience (i.e. the power or ability of a material to return to its original form) of the sealing ring 3 (particularly the resilience of a connecting part 33 described later which is a connecting portion between the hook part 32 and the sealing ring body 31), the sealing ring 3 tends to restore its original shape, and as such, the hook part 32 is biased by the resilience of the sealing ring 3 towards the inner side of the sealing ring body 31, and thus being tightly attached to a surface of the annular flange 12 (i.e. a right side surface of the annular flange 12 according to the orientation of FIG. 4) to achieve a sealed engagement between the hook part 32 and the annular flange 12 to seal the gap therebetween. Accordingly, sealed engagement between the upper connecting piece 1 and the lower connecting piece 2 is achieved, and the sealing performance after closing of the mechanism is ensured. Additionally, since the sealed engagement between the hook part 32 and the annular flange 12 is achieved by the hook part 32 being biased by the resilience of the sealing ring 3 towards the inner side of the sealing ring body 31 so as to tightly attached to the surface of the annular flange 12, while the upper connecting piece 1 (more specifically, the annular flange 12 of the upper connecting piece 1) is inserted into the groove 321 along an axial direction of the through hole 21, the sealing ring 3 generally does not generate friction force against the annular flange 12 along the axial direction of the through hole 21, so that opening and closing of the opening and closing mechanism are easier, smoother, and without jamming, resulting in better user's experience. Moreover, the upper connecting piece 1 and the lower connecting piece 2 of the present invention are made of hard material which can frame a shape of the thermally insulated container. During assembly, the upper connecting piece and the lower connecting piece can be more conveniently assembled with and connected to the cover and the body of the thermally insulated container, thereby improving the production efficiency and yield rate.

With reference to FIGS. 1 to 4, a specific embodiment of the present invention is shown.

The aforementioned hard material is injectable plastic, metal, or solid wood; the injectable plastic can be polyethylene, polypropylene, ABS, PA, polystyrene, etc; the metal can be iron, stainless steel, aluminum alloys, etc; the solid wood can be inexpensive and hard wood material such as pine, rubber wood, and birch; the sealing ring 3 is made of materials such as rubber, silicone, polyvinyl chloride (PVC), thermoplastic polyurethanes (TPU), or thermoplastic rubber (TPR).

A connecting part 33 is formed at a connecting portion between the sealing ring body 31 and the hook part 32; a thickness of the connecting part 33 is smaller than a thickness of the hook part 32, generally one third to half of the thickness of the hook part 32; since the sealing ring 3 is elastic, given that the connecting part 33 is relatively thin, cross-sectional tension of the connecting part 33 is smaller, and thus being more easily deformed (i.e. in the present case, being stretched downwardly and along a radial direction towards the center of the through hole 21) such that the hook part 32 can be more easily driven by the annular flange 12, thereby avoiding the problem that the hook part 32 is disengaged with the annular flange 12 due to failure of the annular flange 12 to drive the hook part 32 which further causes failure to achieve the sealed engagement between the hook part 32 and the annular flange 12 as described above. In this embodiment, the thickness of the connecting part 33 is 1 mm.

An annular platform 22 connected to the side wall of the through hole 21 is formed in the through hole 21; the sealing ring body 31 is rested on the annular platform 22, and the sealing ring body 31 also abuts against the side wall of the through hole 21. The annular platform 22 supports the sealing ring body 31 along the axial direction of the through hole 21.

Further, the present invention also comprises a fixing ring 4. An upper surface of the annular platform 22 is recessed to form a mounting groove 23. A first positioning ring 34 extends downwardly from an outer side edge of the sealing ring body 31; the first positioning ring 34 is inserted into the mounting groove 23. The fixing ring 4 engages with the upper surface of the annular platform 22 and is also fastened to the side wall of the through hole 21; the fixing ring 4 is configured to press against and fix the sealing ring body 31, thereby achieving positioning and installation of the sealing ring 3 on the annular platform 22.

Further, a second positioning ring 35 is formed on an upper surface of the sealing ring body 31, and a limiting groove 41 corresponding to the second positioning ring 35 is formed on a bottom surface of the fixing ring 4; the second positioning ring 35 is inserted into the limiting groove 41 to achieve mutual limiting effect between the sealing ring 3 and the fixing ring 4.

Further, a fastening groove 24 is formed on the side wall of the through hole 21; an outer circumferential surface of the fixing ring 4 is provided with a fastener 42 removably engaged with the fastening groove 24 to achieve fastening between the fixing ring 4 and the side wall of the through hole 21, thereby facilitating rapid installation of the fixing ring 4 in the lower connecting piece 2.

The opening and closing assembly A comprises a buckle 13 provided at the front side of the upper connecting piece 1 and a buckling part 25 provided at the front side of the lower connecting piece 2. When the upper connecting piece 1 closes against the lower connecting piece 2, the buckle 13 is buckled to the buckling part 25, thereby achieving detachable engagement of the front side of the upper connecting piece 1 and the front side of the lower connecting piece 2.

Further, the buckle 13 is fixedly connected to a bottom surface of the front side of the upper connecting piece 1, and a cutaway portion 26 is formed at the front side of the lower connecting piece 2; the buckling part 25 is formed within the cutaway portion 26. After the upper connecting piece 1 is closed against the lower connecting piece 2, the buckle 13 is fitted in the cutaway portion 26, without protruding out of the front sides of the upper connecting piece 1 and the lower connecting piece 2. This maintains a smooth front side of the opening and closing mechanism, thus achieving a flat surface for the thermally insulated container.

The rear side of the upper connecting piece 1 and the rear side of the lower connecting piece are pivotally connected either through a rotating shaft or through a hinge, depending on actual needs.

Figure 5:
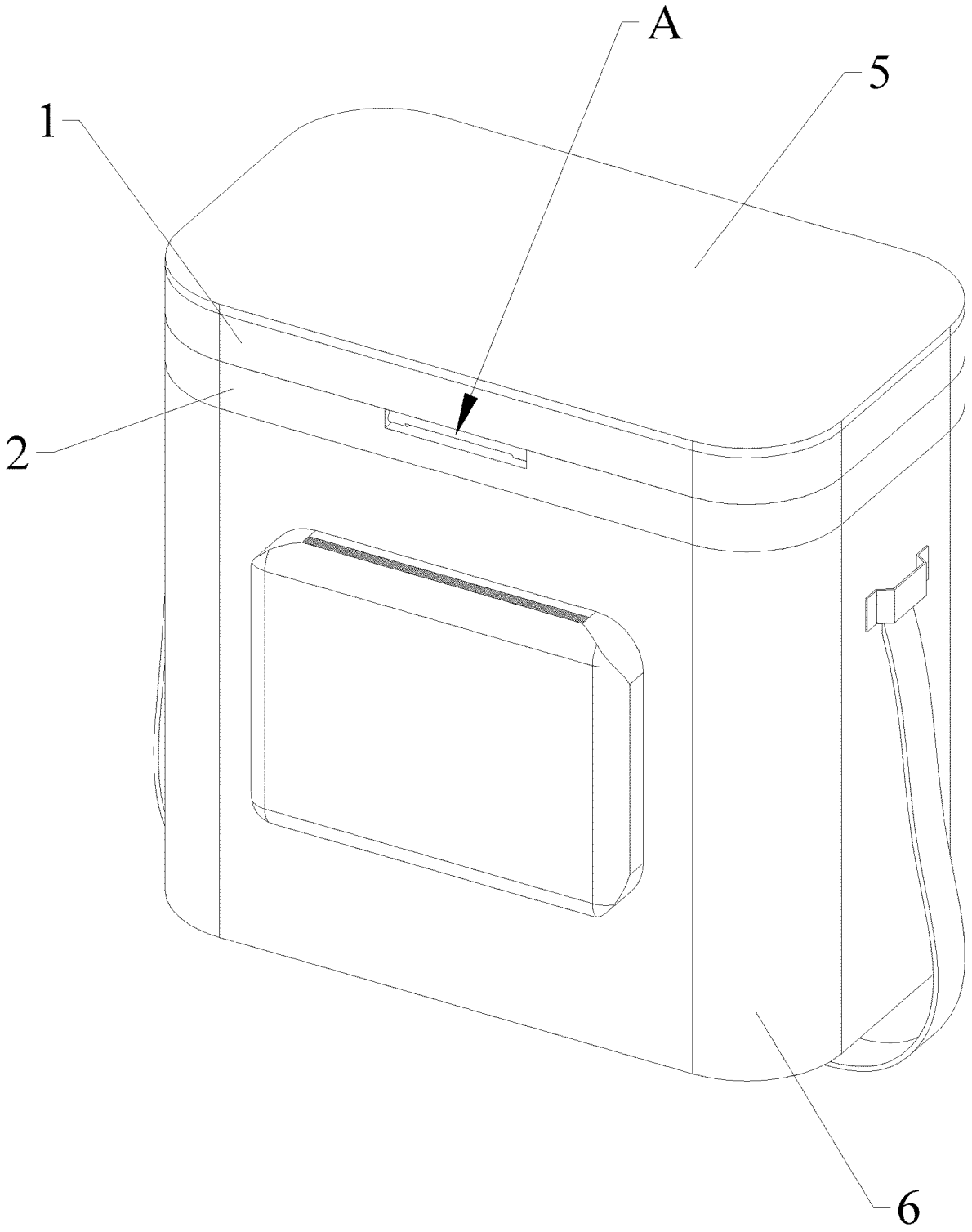
FIG. 5 is a schematic diagram of the opening and closing mechanism according to a specific embodiment of the present invention applied to a thermally insulated container.

With reference to FIG. 5, a thermally insulated container with the opening and closing mechanism described above is shown, comprising the opening and closing mechanism described above, a cover 5, and a body 6; the cover 5 is sealed with an upper surface of the upper connecting piece 1; the lower connecting piece 2 is sealed with an opening of a cavity of the body 6, and the through hole 21 is in communication with the cavity of the body 6. In practice, the body 6 is generally shaped like a box or a bag.

What is claimed is:

1. An opening and closing mechanism, adapted to be used with a thermally insulated container, comprising:

an upper connecting piece, a lower connecting piece, and a sealing ring; the upper connecting piece and the lower connecting piece are both made of hard material;

a rear side of the upper connecting piece and a rear side of the lower connecting piece are pivotally connected, and an opening and closing assembly is provided between a front side of the upper connecting piece and a front side of the lower connecting piece;

a through hole is formed in the lower connecting piece; a protruding part having a shape corresponding to the through hole is provided on the upper connecting piece; a size of the protruding part is smaller than that of the through hole, and the protruding part is removably fitted in the through hole as the upper connecting piece moves pivotally with respect to the lower connecting piece;

the sealing ring comprises a sealing ring body mounted around a side wall of the through hole, and the sealing ring also comprises a hook part disposed around the sealing ring body and extending from an inner side of the sealing ring body into the through hole; the hook part is also integrally connected to the sealing ring body; the hook part has a groove that opens upwardly;

lower edges of the protruding part further extend downwardly to define an annular flange; the annular flange abuts against inner walls of the groove as the upper connecting piece closes against the lower connecting piece, and as the annular flange abuts against the inner walls of the groove, elasticity of the sealing ring allows the hook part to be driven downwardly and along a radial direction towards a center of the through hole;

a connecting part is formed between a connecting portion of the sealing ring body and the hook part; a thickness of the connecting part is smaller than a thickness of the hook part;

the thickness of the connecting part is one third to half of the thickness of the hook part.

2. The opening and closing mechanism of claim 1, wherein an annular platform connected to the side wall of the through hole is formed in the through hole; the sealing ring body is rested on the annular platform, and the sealing ring body also abuts against the side wall of the through hole.

3. The opening and closing mechanism of claim 2, further comprising a fixing ring; an upper surface of the annular platform is recessed to form a mounting groove; a first positioning ring extends downwardly from an outer side edge of the sealing ring body; the first positioning ring is inserted into the mounting groove; the fixing ring engages with the upper surface of the annular platform and is also fastened to the side wall of the through hole.

4. The opening and closing mechanism of claim 3, wherein a second positioning ring is formed on an upper surface of the sealing ring body, and a limiting groove corresponding to the second positioning ring is formed on a bottom surface of the fixing ring; the second positioning ring is inserted into the limiting groove.

5. The opening and closing mechanism of claim 3, wherein a fastening groove is formed on the side wall of the through hole; an outer circumferential surface of the fixing ring is provided with a fastener removably engaged with the fastening groove.

6. The opening and closing mechanism of claim 1, wherein the opening and closing assembly comprises a buckle provided at the front side of the upper connecting piece and a buckling part provided at the front side of the lower connecting piece; when the upper connecting piece closes against the lower connecting piece, the buckle is buckled to the buckling part.

7. The opening and closing mechanism of claim 6, wherein the buckle is fixedly connected to a bottom surface of the front side of the upper connecting piece, and a cutaway portion is formed at the front side of the lower connecting piece; the buckling part is formed within the cutaway portion.

8. The opening and closing mechanism of claim 1, wherein the hard material is injectable plastic, metal or solid wood.

* * * * *